US005791208A

United States Patent [19]

Grubbs

[11] Patent Number: 5,791,208

[45] Date of Patent: Aug. 11, 1998

[54] SCREW EYE DRIVING AND REMOVING DEVICE

[76] Inventor: Howard L. Grubbs, 1003 Marshall Park Dr., Georgetown, Ky. 40324

[21] Appl. No.: 752,661

[22] Filed: Nov. 19, 1996

[51] Int. Cl.[6] ..... B25B 13/06

[52] U.S. Cl. ..... 81/121.1; 81/125; 81/901

[58] Field of Search ..... 81/121.1, 125, 81/124.2, 901, 44, 487

[56] References Cited

U.S. PATENT DOCUMENTS

| | | | |
|---|---|---|---|
| 985,087 | 2/1911 | Wilson | 81/901 X |
| 1,611,154 | 12/1926 | Bretrand | 81/901 X |
| 2,231,323 | 2/1941 | Cawood | 81/125 X |
| 3,416,395 | 12/1968 | Hanson | 81/125 |
| 4,689,881 | 9/1987 | Fall | 81/901 X |
| 4,724,731 | 2/1988 | Onofrio | 81/119 |
| 4,818,157 | 4/1989 | Kouvelis | 81/125 X |
| 4,823,652 | 4/1989 | Morrissey et al. | 81/125 |
| 5,425,193 | 6/1995 | Gelb | 81/901 X |
| 5,615,587 | 4/1997 | Foerster, Jr. | 81/124.2 X |

FOREIGN PATENT DOCUMENTS

| | | | |
|---|---|---|---|
| 206759 | 2/1909 | Germany | 81/901 |

*Primary Examiner*—D. S. Meislin

[57] ABSTRACT

A screw eye driving and removing device comprised of a cylindrical member having a vertical slot formed therein. The vertical slot is dimensioned to receive a rounded end portion of a screw eye therein. The cylindrical member has a horizontal slot extending from a position intermediate an upper end and a lower end of the vertical slot. A drill securement portion is secured to the cylindrical member. A screw eye securement portion is secured within the horizontal slot of the cylindrical member.

1 Claim, 4 Drawing Sheets

SCREW EYE DRIVING AND REMOVING DEVICE

BACKGROUND OF THE INVENTION

1. Field of the Invention

The present invention relates to a screw eye driving and removing device and more particularly pertains to driving and removing screw eyes with the aid of an electric drill with a screw eye driving and removing device.

2. Description of the Prior Art

The use of screw eye driving devices is known in the prior art. More specifically, screw eye driving devices heretofore devised and utilized for the purpose of driving and removing screw eyes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,335,569 to Rowley discloses an eye screw driving device.

U.S. Pat. No. 5,207,404 to Reinhard discloses a drive screw eye or hook.

U.S. Pat. No. 4,689,881 to Fall discloses a head and magazine loader assembly.

U.S. Pat. No. 4, 602,532 to Unger discloses an apparatus for applying and releasing wood screws, provided with suspension hooks, and also magnetic holders, to and from comparatively high structural parts.

U.S. Pat. No. Des. 298,730 to Zin discloses the ornamental design for a screw eye driving attachment for an electric drill.

While these devices fulfill their respective, particular objective and requirements, the aforementioned patents do not describe a screw eye driving and removing device for driving and removing screw eyes with the aid of an electric drill.

In this respect, the screw eye driving and removing device according to the present invention substantially departs from the conventional concepts and designs of the prior art, and in doing so provides an apparatus primarily developed for the purpose of driving and removing screw eyes with the aid of an electric drill.

Therefore, it can be appreciated that there exists a continuing need for new and improved screw eye driving and removing device which can be used for driving and removing screw eyes with the aid of an electric drill. In this regard, the present invention substantially fulfills this need.

SUMMARY OF THE INVENTION

In the view of the foregoing disadvantages inherent in the known types of screw eye driving devices now present in the prior art, the present invention provides an improved screw eye driving and removing device. As such, the general purpose of the present invention, which will be described subsequently in greater detail, is to provide a new and improved screw eye driving and removing device and method which has all the advantages of the prior art and none of the disadvantages.

To attain this, the present invention essentially comprises a cylindrical member having a planar upper surface, a planar lower surface, and a cylindrical side wall therebetween. The planar upper surface has a vertical slot formed therein. The vertical slot has a planar upper end and a curved lower end. The vertical slot is dimensioned to receive a rounded end portion of a screw eye therein. The vertical slot has a length equal to about two-thirds the diameter of the cylindrical member. The cylindrical member has a horizontal slot extending from a position intermediate the planar upper end and curved lower end of the vertical slot. The device includes a drill securement portion comprised of a shaft portion. The shaft portion has a first end and a second end. The first end is secured to the planar lower surface of the cylindrical member. The second end is dimensioned to be received within a nose portion of an electric drill. The device includes a screw eye securement portion. The screw eye securement portion is comprised of a rounded male detent element having a spring secured to a distal portion thereof. The rounded male detent element and spring are secured within the horizontal slot of the cylindrical member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved screw eye driving and removing device which may be easily and efficiently manufactured and marketed.

It is a further object of the present invention to provide a new and improved screw eye driving and removing device which is of durable and reliable construction.

An even further object of the present invention is to provide a new and improved screw eye driving and removing device which is susceptible of a low cost of manufacture with regard to both materials and labor, and which accordingly is then susceptible of low prices of sale to the consuming public, thereby making such a screw eye driving and removing device economically available to the buying public.

Still yet another object of the present invention is to provide a new and improved screw eye driving and removing device which provides in the apparatuses and methods of the prior art some of the advantages thereof, while simultaneously overcoming some of the disadvantages normally associated therewith.

Even still another object of the present invention is to provide a new and improved screw eye driving and removing device for driving and removing screw eyes with the aid of an electric drill.

Lastly, it is an object of the present invention to provide a new and improved screw eye driving and removing device comprised of a cylindrical member having a vertical slot formed therein. The vertical slot is dimensioned to receive a rounded end portion of a screw eye therein. The cylindrical member has a horizontal slot extending from a position intermediate an upper end and a lower end of the vertical slot. A drill securement portion is secured to the cylindrical member. A screw eye securement portion is secured within the horizontal slot of the cylindrical member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
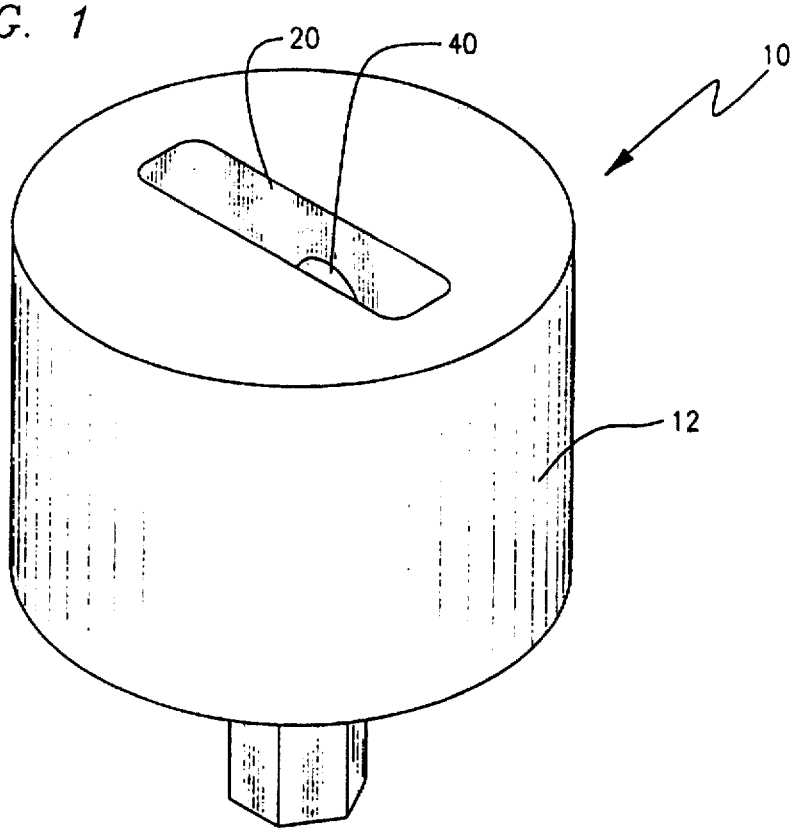
FIG. 1 is a perspective view of the preferred embodiment of the screw eye driving and removing device constructed in accordance with the principles of the present invention.
Figure 2:
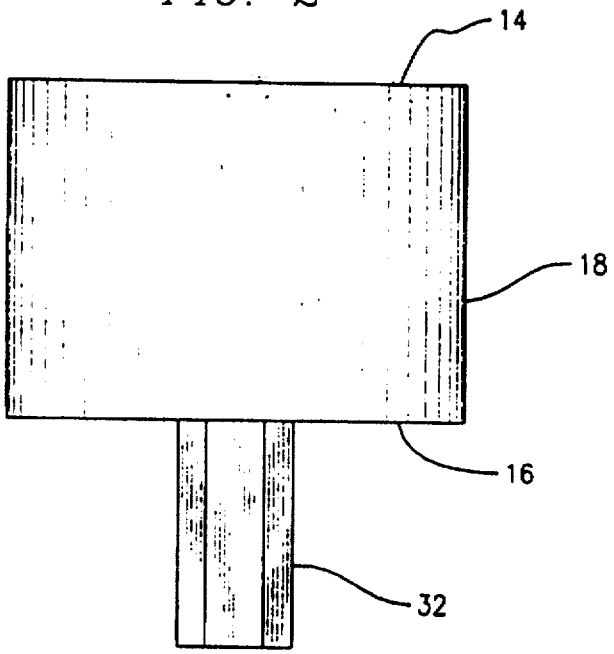
FIG. 2 is a front elevation view of the present invention.
Figure 3:
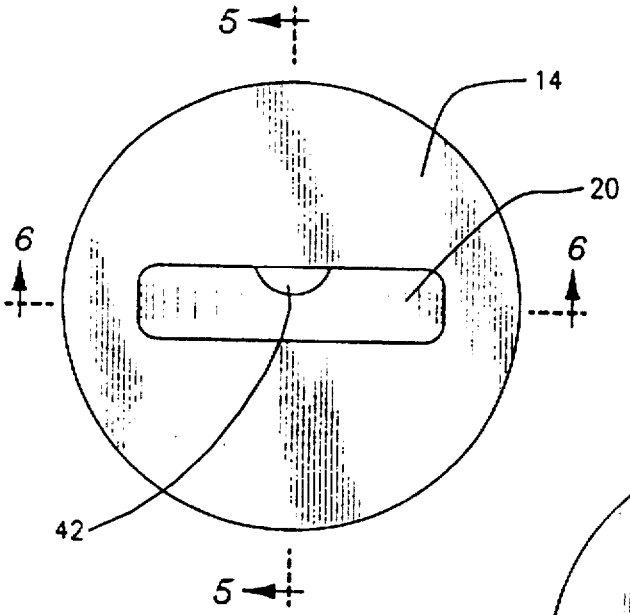
FIG. 3 is a plan view of the preferred embodiment of the present invention.
Figure 4:
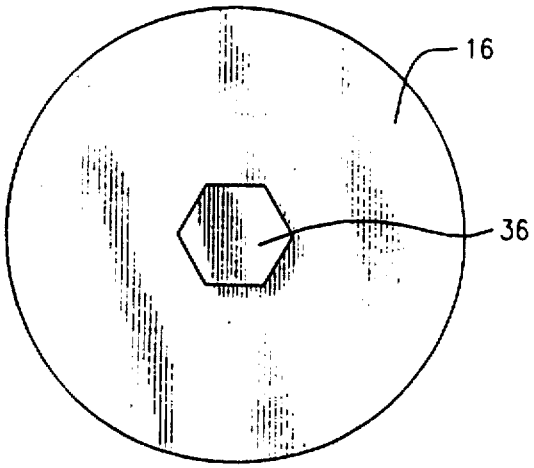
FIG. 4 is a bottom view of the preferred embodiment of the present invention.
Figure 5:
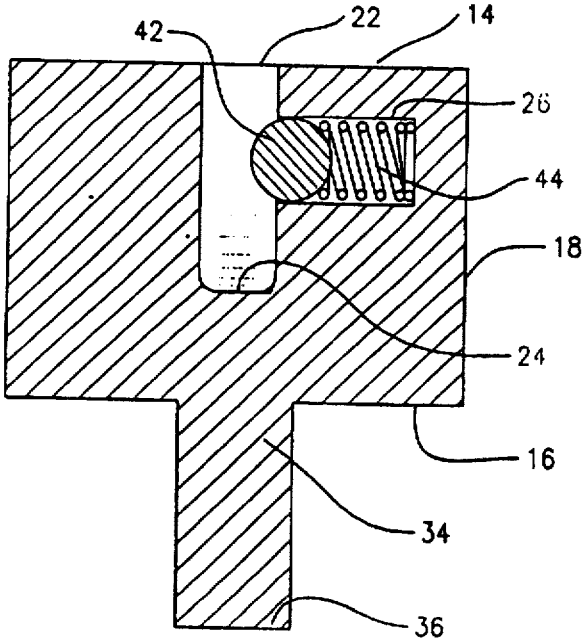
FIG. 5 is a cross-sectional view of the present invention as taken along line 5—5 of FIG. 3.
Figure 6:
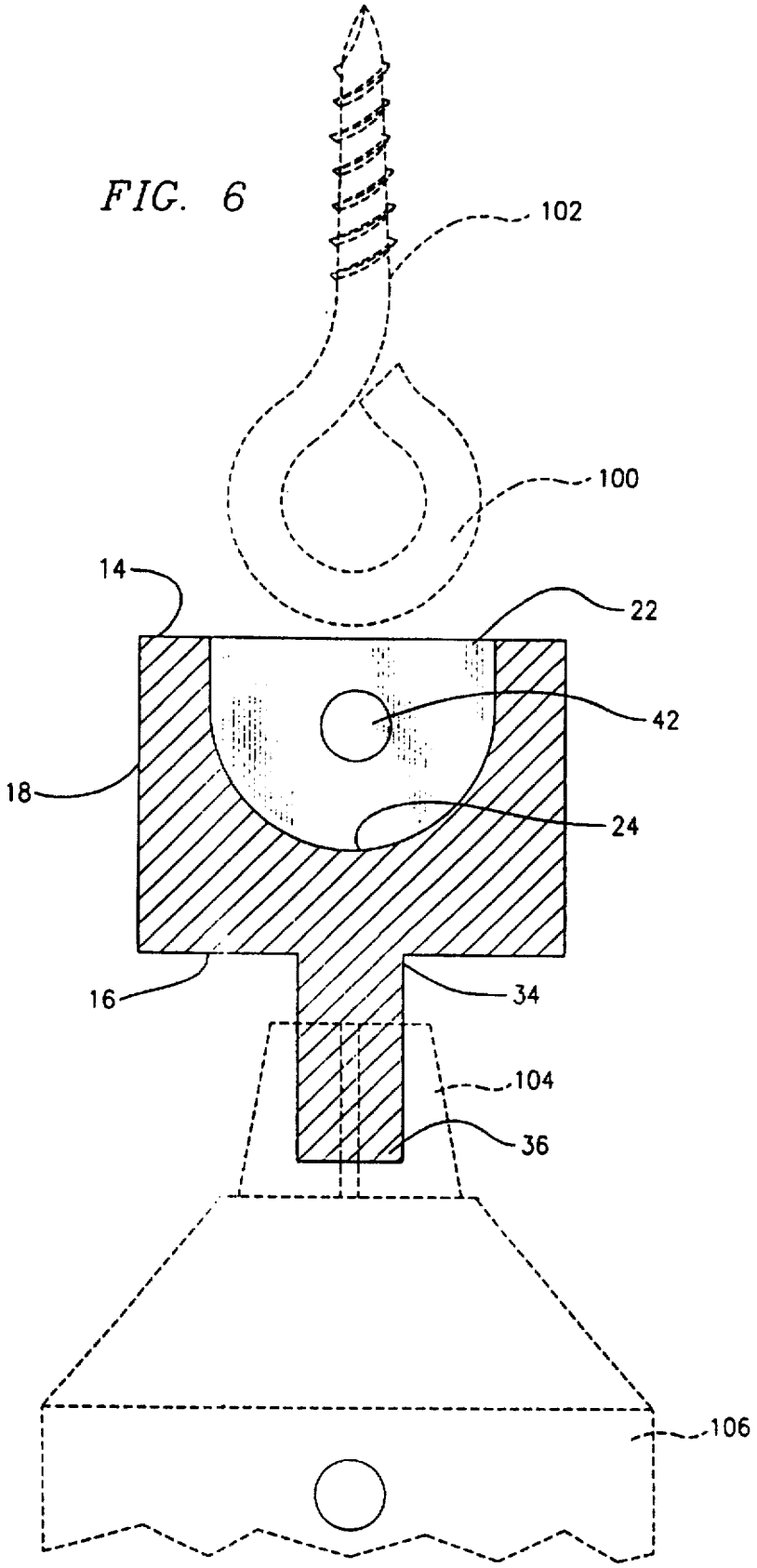
FIG. 6 is a cross-sectional view of the present invention as taken along line 6—6 of FIG. 3.

With reference now to the drawings, and in particular, to FIG. 1 thereof, the preferred embodiment of the new and improved screw eye driving and removing device embodying the principles and concepts of the present invention and generally designated by the reference number 10 will be described.

Specifically, it will be noted in the various Figures that the device relates to a new and improved screw eye driving and removing device for driving and removing screw eyes with the aid of an electric drill. In its broadest context, the device consists of a cylindrical member, a drill securement portion, and a screw eye securement portion. Such components are individually configured and correlated with respect to each other so as to attain the desired objective.

The device 10 includes a cylindrical member 12 having a planar upper surface 14, a planar lower surface 16, and a cylindrical side wall 18 therebetween. The planar upper surface 14 has a vertical slot 20 formed therein. The vertical slot 20 has a planar upper end 22 and a curved lower end 24. The vertical slot 20 has a U-shape. The vertical slot 20 is dimensioned to receive a rounded end portion 100 of a screw eye 102 therein. The vertical slot 20 is designed to snugly receive the rounded end portion 100 of the screw eye 102 therein. The vertical slot 20 has a length equal to about two-thirds the diameter of the cylindrical member 12. The vertical slot 20 has a depth equal to about two-third the length of the cylindrical side wall 18. The cylindrical member 12 has a horizontal slot 26 extending from a position intermediate the planar upper end 22 and curved lower end 24 of the vertical slot 20. The diameter of the cylindrical member 12 is greater than its overall length. The cylindrical member 12 is preferably fabricated of steel or other metal material.

Next, the device 10 includes a drill securement portion comprised of a shaft portion 32. The shaft portion 32 has a first end 34 and a second end 36. The first end 34 is secured to the planar lower surface 16 of the cylindrical member 12. The second end 36 is dimensioned to be received within a nose portion 104 of an electric drill 106. The shaft portion 32 preferably has a hexagonal cross-section for securement within the nose portion 104 of the electric drill 106. The shaft portion 32 preferably has a length equal to the depth of the vertical slot 20 of the cylindrical member 12. The shaft portion 32 is fabricated of a similar material as the cylindrical member 12.

Lastly, the device 10 includes a screw eye securement portion 40. The screw eye securement portion 40 is comprised of a rounded male detent element 42 having a spring 44 secured to a distal portion thereof. The rounded male detent element 42 and spring 44 are secured within the horizontal slot 26 of the cylindrical member 12. The male detent element 42, when extended outwardly, extends nearly half way into the vertical slot 20. A user takes a screw eye 102 and inserts its rounded end portion 100 into the vertical slot 20 of the cylindrical member 12. The rounded end portion 100 pushes the male detent element inwardly of the horizontal slot 26 thus allowing the rounded end portion 100 to be positioned at the curved lower end 24 of the vertical slot 20 thereby causing the male detent element 42 to expand outwardly to frictionally contain the screw eye 102 within the vertical slot 20. The shaft portion 32 is then coupled with an electric drill 106 to impress the screw eye 102 in a desired location. The cylindrical member 12 can then be removed from the screw eye 102 by applying limited force.

Figure 7:
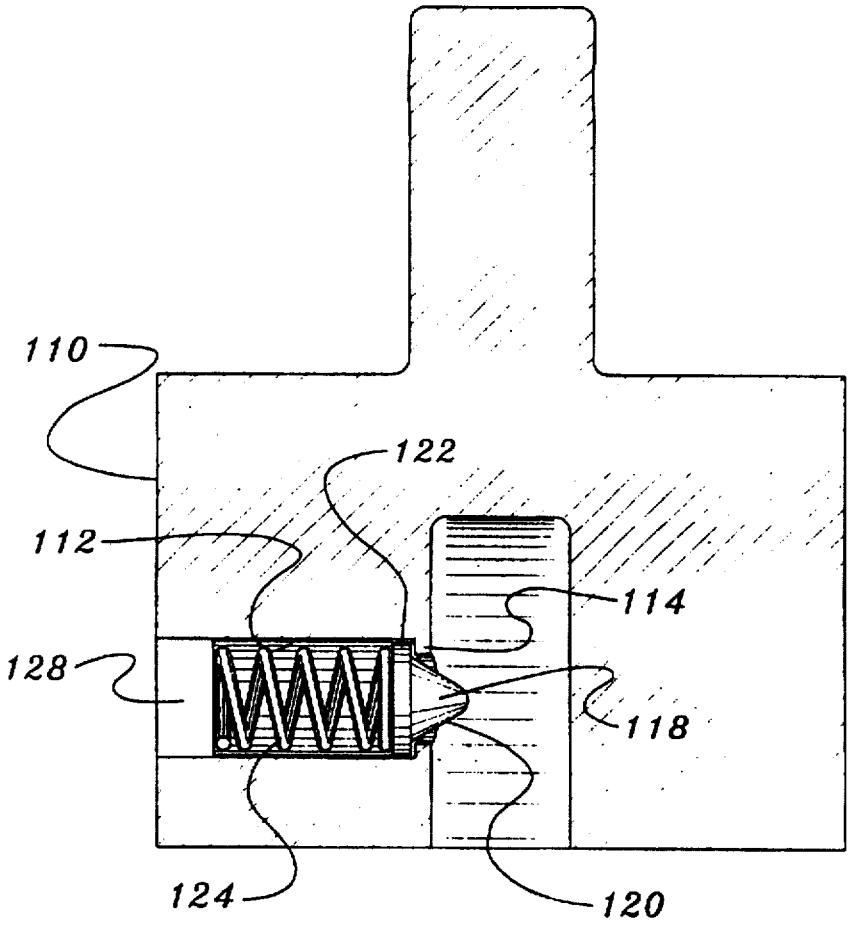
FIG. 7 is a cross-sectional view of a second embodiment of the present invention.

FIG. 7 illustrates an alternate embodiment of the present invention. In the alternate embodiment, the rounded male detent element 42 is replaced with a cone shaped male detent element 118. The cone shaped male detent element 118 is placed within the side wall 110 of the cylindrical member 12 through a horizontal chamber 112 bored thereinto. The horizontal chamber 112 includes an opening 114 entering into the vertical slot 20. The cone shaped male detent element 118 is further defined by a pointed exterior portion 120 and an annular interior portion 122. The annular interior portion 122 has a diameter greater than a diameter of the opening 114 thereby precluding the cone shaped male detent element 118 from entering into the vertical slot 20 more than the ⅓ that is does. The annular interior portion 122 has a spring member 124 extending rearwardly therefrom. A free end of the spring member 124 abuts a filler material 128 used to fill the horizontal chamber 112 from outside of the cylindrical member 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A screw eye driving and removing device for driving and removing screw eyes with the aid of an electric drill comprising, in combination:

a cylindrical member having a planar upper surface, a planar lower surface, and a cylindrical side wall therebetween, the planar upper surface having a vertical slot formed therein, the vertical slot having a planar upper end and a curved lower end and opposing parallel planar side walls together forming the vertical slot with smaller end walls at right angles thereto, the vertical slot being dimensioned to receive a rounded end portion of a screw eye therein between the opposing planar side walls, the vertical slot having a length about two-thirds the diameter of the cylindrical member and a depth equal to about two-thirds the length of the cylindrical member, the cylindrical member having a horizontal slot extending from a position intermediate the planar upper end and curved lower end of the vertical slot, wherein the cylindrical member is fabricated of steel;

a drill securement portion comprised of a shaft portion having a first end and a second end, the first end secured to the planar lower surface of the cylindrical member, the second end dimensioned to be received within a nose portion of an electric drill, wherein the shaft portion has a hexagonal cross-section for securement within a nose portion of an electric drill and a length equal to the depth of the vertical slot of the cylindrical member;

a screw eye securement portion comprised of a male detent element having a spring secured to a distal portion thereof, the male detent element and spring secured within the horizontal slot of the cylindrical member and extending from one side wall toward an opposing side wall, whereby the male detent element engages a central opening in a screw eye upon insertion within the vertical slot, wherein the male detent element is cone shaped and the horizontal slot includes an opening entering into the vertical slot, the cone shaped male detent element further defined by a pointed exterior portion and an annular interior portion, the annular interior portion having a diameter greater than a diameter of the opening and the male detent element thereby precluding the cone shaped male detent element from entering into the vertical slot by way of a planar surface abutment, a free end of the spring abuts a filler material used to fill the horizontal chamber from outside of the cylindrical member with the filler material being formed of a material different from that of the cylindrical member;

whereby a rounded end portion of a screw eye is inserted into the vertical slot of the cylindrical member thereby pushing the male detent element inwardly of the horizontal slot thus allowing the rounded end portion to be positioned at the curved lower end of the vertical slot causing the male detent to expand outwardly to frictionally contain the screw eye within the vertical slot.

* * * * *